United States Patent [19]

Smith

[11] 4,194,103

[45] Mar. 18, 1980

[54] ELECTRICAL SWITCH CONSTRUCTION AND METHOD OF MAKING THE SAME

[75] Inventor: William N. Smith, Knoxville, Tenn.

[73] Assignee: Robertshaw Controls Company, Richmond, Va.

[21] Appl. No.: 941,917

[22] Filed: Sep. 13, 1978

[51] Int. Cl.[2] ..... H01H 5/18; H01H 13/36

[52] U.S. Cl. ..... 200/67 E; 29/622; 200/83 P; 200/83 S; 200/153 V; 200/250

[58] Field of Search ..... 29/622; 200/67 DA, 67 E, 200/83 P, 83 S, 83 SA, 83 T, 153 V, 250

[56] References Cited

U.S. PATENT DOCUMENTS

| | | | |
|---|---|---|---|
| 3,989,914 | 11/1976 | Stearley et al. | 200/153 V X |
| 4,109,121 | 8/1978 | Bauer et al. | 200/67 DA X |

*Primary Examiner*—Frederick R. Schmidt

*Attorney, Agent, or Firm*—Candor, Candor & Tassone

[57] ABSTRACT

A double throw electrical switch construction having a housing carrying a movable actuator unit for moving a snap switch blade of the housing over center to snap a contact portion of the blade between a pair of spaced contact stops carried by the housing, the actuator unit comprising an actuator plunger and an actuator spring. The actuator spring is movable relative to the housing and has one of the opposed ends thereof operatively interconnected to the blade to move the blade as the spring is moved. The plunger has a lost motion arrangement for acting against an intermediate portion of the actuator spring to cause movement thereof as the actuator plunger is moved whereby the actuator spring can move relative to the actuator plunger through the lost motion arrangement thereof. One of the opposed ends of the actuator spring comprises a pair of spaced apart legs being interconnected together by a narrow band of the actuator spring, the narrow band comprising the intermediate portion of the actuator spring on which the lost motion arrangement of the actuator plunger acts against.

20 Claims, 4 Drawing Figures

ELECTRICAL SWITCH CONSTRUCTION AND METHOD OF MAKING THE SAME

BACKGROUND OF THE INVENTION

1. Field of the Invention

This invention relates to an improved electrical switch construction and to a method of making the same.

2. Prior Art Statement

It is known to applicant to provide an electrical switch construction having a housing carrying a pair of spaced contact stops and a snap switch blade having a contact portion for being snapped between the stops when the blade is moved over center by an actuator spring member that is operatively interconnected to the blade and is movable relative to the housing by an actuator plunger.

For example, see:

(1) U.S. Pat. No. 4,109,121—Bauer et al.

The actuator spring of item (1) above, has opposed ends interconnected to the switch blade and an intermediate portion adapted to be acted against by a lost motion means of an actuator plunger whereby the actuator spring can move relative to the actuator plunger through the lost motion means thereof and cause the contact portion of the switch blade to snap over center.

SUMMARY OF THE INVENTION

It is a feature of this invention to provide an improved electrical switch construction of the above type by utilizing an improved actuator spring and actuator plunger therewith.

In particular, one embodiment of this invention provides a double throw electrical switch construction having a housing means carrying movable actuator means for moving a snap switch blade of the housing means over center to snap a contact portion of the blade between a pair of spaced contact stops carried by the housing means, the actuator means comprising an actuator plunger and an actuator spring. The actuator spring is movable relative to the housing means and has one of the opposed ends thereof operatively interconnected to the blade to move the blade as the spring is moved. The actuator plunger has lost motion means for acting against an intermediate portion of the actuator spring to cause movement thereof as the actuator plunger is moved whereby the actuator spring can move relative to the actuator plunger through the lost motion means thereof. One of the opposed ends of the actuator spring comprises a pair of spaced apart legs, the legs being interconnected together by a narrow band of the actuator spring with the narrow band comprising the intermediate portion of the actuator spring on which the lost motion means of the actuator plunger acts against.

The lost motion means of the actuator plunger comprises a pair of spaced shoulders on the actuator plunger that receives the narrow band of the actuator spring therebetween, the pair of shoulders being defined by a transverse notch formed in one side of the actuator plunger and extending from that one side and through the longitudinal axis of the actuator plunger.

Accordingly, it is an object of this invention to provide an improved electrical switch construction having one or more of the novel features of this invention as set forth above or hereinafter shown or described.

Another object of this invention is to provide a method of making an electrical switch construction or the like, the method of this invention having one or more of the novel features as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
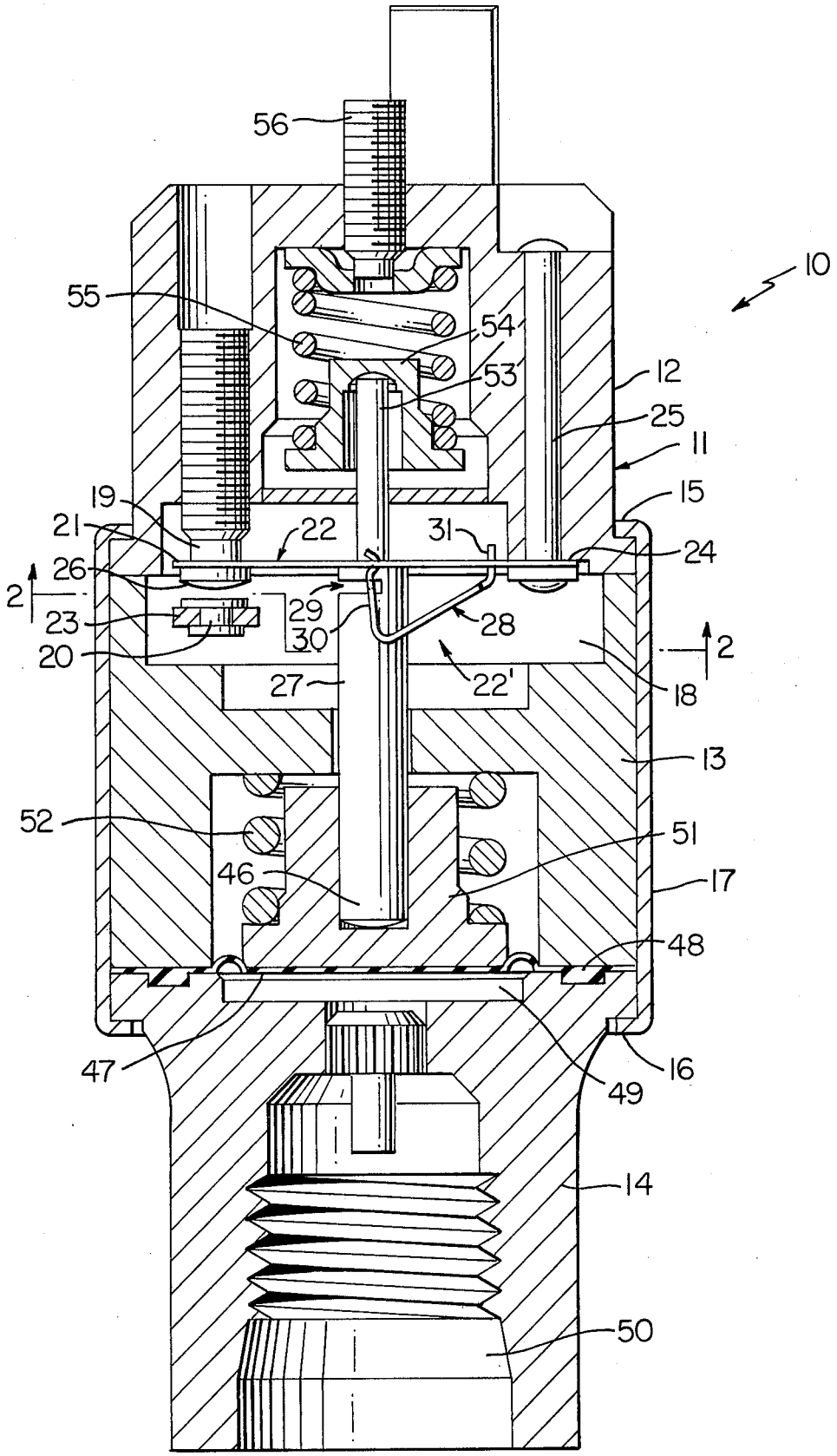
FIG. 1 is a cross-sectional view illustrating the improved electrical switch construction of this invention.

While the various features of this invention are hereinafter described and illustrated as being particularly adapted to provide a miniature switch to be used in controls where extremely tight tolerances must be held with the switch having a high degree of repeatability, it is to be understood that the various features of this invention can be utilized singly or in any combination thereof to provide an electrical switch construction for other uses as desired.

Therefore, this invention is not to be limited to only the embodiment illustrated in the drawings, because the drawings are merely utilized to illustrate one of the wide variety of uses of this invention.

Referring now to FIG. 1, the improved electrical switch construction of this invention is generally indicated by the reference numeral 10 and comprises a housing means 11 made from a plurality of housing parts 12, 13 and 14 suitably secured together in stacked aligned relation, such as by turning over the opposed ends 15 and 16 of a telescoping sleeve 17 in the manner illustrated in FIG. 1 whereby a chamber 18 is formed between the housing members 11 and 13.

A pair of spaced contact stops 19 and 20 are carried by the housing means 11 in the chamber 18 and between which a contact portion 21 of a conductive snap switch blade 22 is adapted to be moved with a snap action by an actuator means of the electrical switch construction 10 that is generally indicated by the reference numeral 22'.

The contact stop 20 of the electrical switch construction 10 is electrically interconnected to a terminal 23 of the housing means 11 while the conductive switch blade 22 has its other end 24 electrically interconnected to another terminal means 25 of the housing means 11 whereby the contact portion 21 of the switch blade 22 is adapted to electrically interconnect the terminals 23 and 25 together when the contact portion 21 has its contact 26 snapped and held against the contact stop 20 by the actuator means 22' in a manner hereinafter set forth.

The actuator means 22' comprises an axially movable actuator plunger 27 and an actuator spring 28 operatively interconnected to the actuator plunger 27 through a lost motion means 29 of the actuator plunger 27 in a manner hereinafter described.

Figure 4:
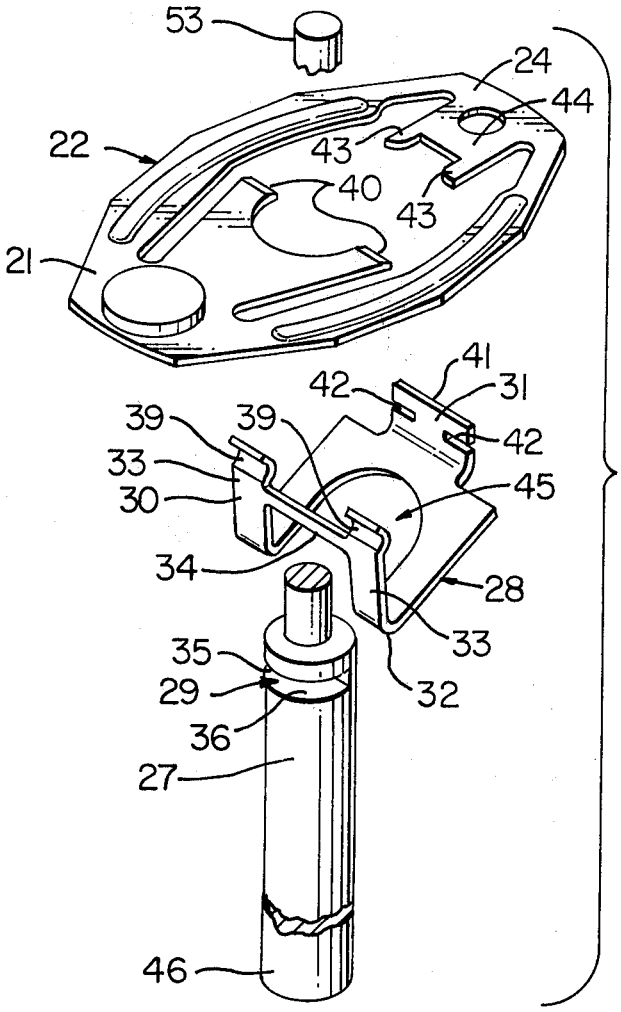
FIG. 4 is an exploded perspective view of the switch blade, actuator spring and actuator plunger of the electrical switch construction of FIG. 1.

As illustrated in FIG. 4, the actuator spring 28 has a pair of opposed ends 30 and 31 and is substantially V-shape with an apex portion 32 disposed between the opposed ends 30 and 31.

Figure 3:
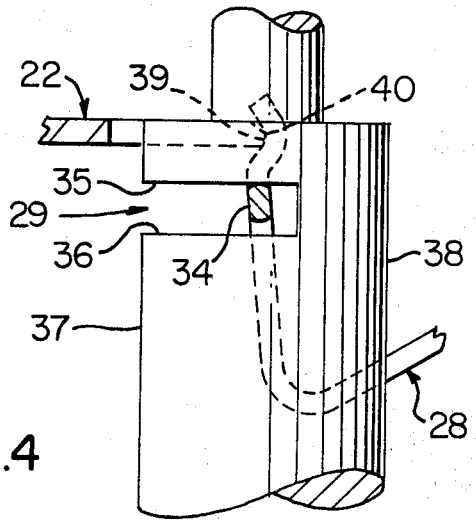
FIG. 3 is an enlarged fragmentary view of the actuating plunger and actuator spring of the electrical switch construction of FIG. 1.

The end 30 of the actuator spring 28 is defined by a pair of spaced apart parallel legs 33 that are interconnected together by a narrow band 34 of the actuator spring 28 that is adapted to be received in the lost motion means 29 of the actuator plunger 27 in the manner illustrated in FIG. 3 to be acted upon by opposed shoulder means 35 and 36 of the actuator plunger 27 that define the lost motion means 29 therebetween.

In particular, the shoulders 35 and 36 of the actuator plunger 27 are defined by a notch that was cut into one side 37 of the actuator plunger 27 and extends toward the other side 38 thereof while passing through the longitudinal axis of the actuator plunger 27 as illustrated.

The narrow band 34 of the actuator spring 28 comprises an intermediate portion of the actuator spring 28 that is disposed intermediate the opposed ends 30 and 31 thereof and one which the lost motion means 29 of the actuator plunger 27 acts against.

The legs 33 of the actuator spring 28 respectively have concave surfaces 39 which respectively receive tongue edges 40 of the switch blade 22 that extend from the contact portion 21 thereof.

Figure 2:
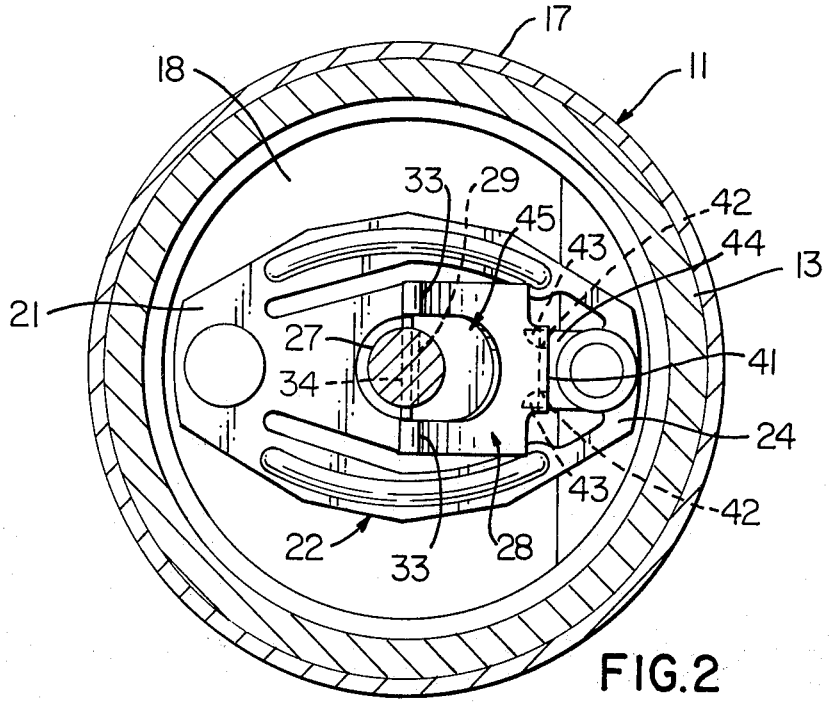
FIG. 2 is a cross-sectional view taken on line 2—2 of FIG. 1.

The other end 31 of the actuator spring 28 comprises a tongue 41 having a pair of side notches 42 formed therein to respectively receive tongue extensions 43 of an inwardly directed tongue 44 of the switch blade 22 therein as illustrated in FIG. 2 whereby the actuator spring 28 is placed under compression between the opposed ends 30 and 31 thereof when the actuator spring 28 is assembled between the tongues 40 and 44 of the actuator spring 42 for the reasons fully set forth in the aforementioned U.S. Pat. No. 4,109,121.

Therefore, it can be seen that the legs 33 of the end 30 of the actuator spring 28 not only extend from the intermediate portion 34 thereof to define the apex 32 of the triangular shape of the actuator spring 28, but also the legs 33 extend to the tongue 41 thereof that forms the other end 31 as illustrated whereby an opening that is generally indicated by the reference numeral 45 passes through the actuator spring 28 and through which the actuator plunger 27 can be assembled to the spring 28 as illustrated.

The actuator plunger 27 has one end 46 that, in effect, bears against a flexible diaphragm 47 having its outer peripheral portion 48 held between the housing portions 13 and 14 to cooperate with the housing member 14 and define a chamber 49 therewith which is adapted to receive fluid under pressure from an inlet means 50 formed in the housing means 11.

A spring retainer 51 is carried on the end 46 of the actuator plunger 27 and bears against the diaphragm 47 while being urged downwardly in FIG. 1 by a compression spring 52.

The other end 53 of the actuator plunger 27 is received in a spring retainer 54 which is urged downwardly in the drawings by a compression spring 55 which can have the force thereof adjusted by a suitable adjusting member 56 in a manner well known in the art.

In this manner the force of the compression spring 55 tends to maintain the actuator plunger 27 downwardly as illustrated in FIG. 1 to hold the contact portion 21 of the snap blade 22 against the contact stop 19 and, thus, out of electrical connection with the contact stop 20 to prevent electrical connection between the terminal means 23 and 25.

However, when sufficient fluid pressure builds up in the chamber 49 to overcome not only the force of the compression spring 55, but also the force of the compression spring 52, the actuator plunger 27 is moved upwardly to cause the switch blade 22 to snap its contact portion 21 downwardly in a manner hereinafter set forth to place the contact portion 21 into contact with the contact stop 20 and thereby interconnect the terminal means 23 and 25 together.

Subsequently, should the fluid pressure in the chamber 49 decrease so that the force of the compression springs 55 and 52 again move the actuator plunger 27 downwardly, the actuator plunger will cause the switch blade 22 to snap its contact portion 21 upwardly from the contact stop 20 and against the contact stop 19 as illustrated in FIG. 1 to terminate the electrical connection between the contact means 23 and 25.

Therefore, it can be seen that the electrical switch construction of this invention can be formed of relatively few parts by the methods of this invention to operate in a manner now to be described.

Assuming that the electrical switch construction 10 is in the condition illustrated in FIG. 1 where the contact portion 21 of the switch blade 22 is disposed against the contact stop 19, no electrical current is adapted to flow between the terminal means 23 and 25.

However, should the pressure value of the pressure fluid being directed to the chamber 49 and acting against the diaphragm 47 increase to such a value that the diaphragm 47 is adapted to move upwardly in opposition to the force of the compression springs 52 and 55, the lower shoulder 36 of the actuator plunger 27 makes contact with the intermediate portion or narrow band 34 of the actuator spring 28 and tends to pivot the actuator spring 28 in a clockwise direction as the actuator plunger 27 continues to move upwardly. As fully set forth in the aforementioned U.S. Pat. No. 4,109,121, the actuator spring 28 itself first snaps over center through the stored spring energy thereof before the blade 22 snaps over center so that the upwardly moving actuator 27 snaps the actuator spring 28 over center and permits the intermediate portion 34 to move from the shoulder 36 through the lost motion means 29 to the shoulder 35 of the actuator plunger at a very rapid rate and such snapping movement of the actuator spring 28 causes the contact portion 21 of the snap blade 22 to snap downwardly from the contact stop 19 to the contact stop 20 and interconnect the terminal means 23 and 25 together. Such snap movement of the blade portion 21 is caused by the action of the spring 28 on the tongues 40 of the blade 22 as fully set forth in the aforementioned U.S. Pat. No. 4,109,121.

In this manner, the contact blade 22 maintained its contact portion 21 in contact with the contact stop 19 with a sustaining contact force until the actuator spring 28 snapped over center for the reasons fully set forth in the aforementioned U.S. Pat. No. 4,109,121.

Subsequently, should the pressure value of the pressure fluid in the chamber 49 decrease, so that the force of the compression springs 55 and 52 tend to move the actuator plunger 27 downwardly, the shoulder 35 of the actuator plunger 27 makes contact with the intermediate portion 34 of the actuator spring 28 to begin to move the actuator spring 28 in a counterclockwise direction and at a certain point in the downward movement of the actuator plunger 27, the actuator spring 28 is snapped over center so that the intermediate portion 34 rapidly moves away from the shoulder 35 and through the lost motion means 29 to the shoulder 36 for the reasons previously set forth to cause the switch blade 22 to now snap the contact portion 21 thereof upwardly from the contact 20 to the contact 19 and thereby terminate the electrical connection between the terminal means 23 and 25, the contact portion 21 of the blade 22 being maintained in contact with the stop 20 with a certain contact force until the spring 28 is snapped over center.

Thus, it can be seen that the electrical switch construction 10 is adapted to cycle the contact portion 21 between the contact stops 19 and 20 depending upon the pressure value of the fluid being supplied to the chamber 49 for any desired control purpose, such as for the purposes set forth in the copending patent application, Ser. No. 880,202, filed Feb. 22, 1978.

Accordingly, it can be seen that through the unique arrangement of the lost motion means 29 of the actuator plunger 27 being formed by a notch cut into the actuator plunger 27 and having the intermediate portion 34 of the actuator spring 28 comprise a narrow band interconnecting together the end legs 33 thereof, the electrical switch construction 10 can be made to function in an accurate manner and sustain a contact force on the contact stops thereof until the actuator spring 28 is snapped over center for all the reasons fully set forth and claimed in the aforementioned copending patent application and U.S. Pat. No. 4,109,121.

Therefore, it can be seen that this invention not only provides an improved electrical switch construction, but also this invention provides a method of making such an electrical switch construction or the like.

While the form and method of this invention now preferred have been illustrated and described as required by the Patent Statute, it is to be understood that other forms and method steps can be utilized and still fall within the scope of the appended claims.

What is claimed is:

1. In a double throw electrical switch construction having a housing means carrying movable actuator means for moving a snap switch blade of said housing means overcenter to snap a contact portion of said blade between a pair of spaced contact stops carried by said housing means, said actuator means comprising an actuator plunger and an actuator spring, said actuator spring having opposed ends and an intermediate portion between said opposed ends thereof, said actuator spring being movable relative to said housing means and having one of said opposed ends thereof operatively interconnected to said blade to move said blade as said spring is moved, said plunger having lost motion means for acting against said intermediate portion of said actuator spring to cause movement thereof as said actuator plunger is being moved whereby said actuator spring can move relative to said actuator plunger through said lost motion means thereof, the improvement wherein one of said opposed ends of said actuator spring comprises a pair of spaced apart legs, said legs being interconnected together by a narrow band of said actuator spring, said narrow band comprising said intermediate portion of said actuator spring on which said lost motion means of said plunger acts against.

2. An electrical switch construction as set forth in claim 1 wherein said actuator spring is substantially V-shaped and thereby has an apex intermediate said opposed ends thereof.

3. An electrical switch construction as set forth in claim 2 wherein said narrow band is disposed intermediate said apex and said one end that comprises said legs.

4. An electrical switch construction as set forth in claim 3 wherein the other of said ends of said actuator spring comprises a tongue.

5. An electrical switch construction as set forth in claim 4 wherein said tongue is disposed remote from said apex, said legs continuing from said narrow band to form said apex and extend from said apex to interconnect to said tongue.

6. An electrical switch construction as set forth in claim 5 wherein said switch blade has tongue means respectively interconnected to said ends of said actuator spring.

7. An electrical switch construction as set forth in claim 1 wherein said one end of said actuator spring that is operatively interconnected to said switch blade comprises said one end that defines said pair of legs.

8. An electrical switch construction as set forth in claim 1 wherein said lost motion means of said actuator plunger comprises a pair of spaced shoulders on said actuator plunger that receive said narrow band therebetween and are adapted to respectively engage said narrow band of said actuator spring to act thereon.

9. An electrical switch construction as set forth in claim 8 wherein said pair of shoulders are defined by a transverse notch formed in one side of said actuator plunger.

10. An electrical switch construction as set forth in claim 9 wherein said actuator plunger has a longitudinal axis, said notch extending from said one side of said actuator plunger through said axis.

11. In a method of making a double throw electrical switch construction having a housing means carrying movable actuator means for moving a snap switch blade of said housing means overcenter to snap a contact portion of said blade between a pair of spaced contact stops carried by said housing means, said actuator means comprising an actuator plunger and an actuator spring, said actuator spring having opposed ends and an intermediate portion between said opposed ends thereof, said actuator spring being movable relative to said housing means and having one of said opposed ends thereof operatively interconnected to said blade to move said blade as said spring is moved, said plunger having lost motion means for acting against said intermediate portion of said actuator spring to cause movement thereof as said actuator plunger is being moved whereby said actuator spring can move relative to said actuator plunger through said lost motion means thereof, the improvement comprising the steps of forming one of said opposed ends of said actuator spring to comprise a pair of spaced apart legs, interconnecting said legs together by a narrow band of said actuator spring, and forming said narrow band to comprise said intermediate portion of said actuator spring on which said lost motion means of said plunger acts against.

12. A method as set forth in claim 11 and including the step of forming said actuator spring to be substantially V-shaped and thereby have an apex intermediate said opposed ends thereof.

13. A method as set forth in claim 12 and including the step of forming said narrow band so as to be disposed intermediate said apex and said one end that comprises said legs.

14. A method as set forth in claim 13 and including the step of forming the other of said ends of said actuator spring to comprise a tongue.

15. A method as set forth in claim 14 and including the steps of forming said tongue to be disposed remote from said apex, and forming said legs to continue from said narrow band to form said apex and extend from said apex to interconnect to said tongue.

16. A method as set forth in claim 15 and including the steps of forming said switch blade with tongue means, and interconnecting said tongue means respectively to said ends of said actuator spring.

17. A method as set forth in claim 11 and including the step of forming said one end of said actuator spring that is operatively interconnected to said switch blade to comprise said one end that defines said pair of legs.

18. A method as set forth in claim 11 and including the step of forming said lost motion means of said actuator plunger to comprise a pair of spaced shoulders on said actuator plunger that receive said narrow band therebetween and are adapted to respectively engage said narrow band of said actuator spring to act thereon.

19. A method as set forth in claim 18 and including the step of forming said pair of shoulders by forming a transverse notch in one side of said actuator plunger.

20. A method as set forth in claim 19 and including the step of forming said notch to extend from said one side of said actuator plunger through the longitudinal axis thereof.

* * * * *